US008904837B1

(12) United States Patent
Lin

(10) Patent No.: US 8,904,837 B1
(45) Date of Patent: Dec. 9, 2014

(54) ELECTRONIC LOCK WITH LED INDICATORS

(71) Applicant: Sunn Fire International Co., Ltd., Taichung (TW)

(72) Inventor: Shih Tsang Lin, Taichung (TW)

(73) Assignee: Sunn Fire International Co., Ltd., Taichung (TW)

( * ) Notice: Subject to any disclaimer, the term of this patent is extended or adjusted under 35 U.S.C. 154(b) by 0 days.

(21) Appl. No.: 14/028,505

(22) Filed: Sep. 16, 2013

(51) Int. Cl.
*E05B 47/06* (2006.01)
*E05B 17/10* (2006.01)
*E05B 49/00* (2006.01)

(52) U.S. Cl.
CPC ..... *E05B 17/10* (2013.01); *E05B 49/00* (2013.01)
USPC ..... 70/285; 70/278.1; 70/278.7; 70/279.1; 109/59 R; 109/59 T

(58) Field of Classification Search
CPC ..... E05B 47/001; E05B 47/0002; E05B 47/0003; E05B 47/0004; E05B 47/02; E05B 47/023; E05B 47/026; E05B 47/06; E05B 47/0603; E05B 47/0665; E05B 47/0673
USPC ..... 70/284, 285, DIG. 63, DIG. 51, DIG. 71, 70/277, 278.1, 278.3, 278.7, 279.1, 283, 70/214; 109/59 R, 59 T; 362/100
See application file for complete search history.

(56) References Cited

U.S. PATENT DOCUMENTS

| | | | | | |
|---|---|---|---|---|---|
| 3,702,070 | A * | 11/1972 | Gartner | 70/278.1 |
| 5,487,289 | A * | 1/1996 | Otto et al. | 70/279.1 |
| 5,778,708 | A * | 7/1998 | Crosby et al. | 70/118 |
| 5,887,467 | A * | 3/1999 | Butterweck et al. | 70/278.7 |
| 7,932,810 | B2 * | 4/2011 | Gartner | 340/5.2 |
| 8,479,543 | B2 * | 7/2013 | Yang et al. | 70/118 |
| 2003/0079663 | A1 * | 5/2003 | Suggs et al. | 109/59 R |
| 2006/0032418 | A1 * | 2/2006 | Smith | 109/59 R |
| 2012/0060726 | A1 * | 3/2012 | Yao et al. | 109/63.5 |

* cited by examiner

*Primary Examiner* — Lloyd Gall

(57) ABSTRACT

An electronic lock for locking or unlocking a door of a safe is provided with a housing mounted on the door; an axis-shaped coder disposed in the housing; a dial mounted on the coder; a plurality of LEDs disposed in the housing; an electromechanical solenoid disposed in the housing; a latch bolt operatively connected to the electromechanical solenoid; a fastening unit disposed in the housing and including a clamping element put on the latch bolt; a pin tumbler lock secured to the housing and including a keyhole and a lever; a microcontroller disposed in the housing for controlling the coder, the electromechanical solenoid, and the LEDs; and a battery disposed in the housing for supplying electricity to the coder, the microcontroller, the electromechanical solenoid, and the LEDs.

4 Claims, 8 Drawing Sheets

ELECTRONIC LOCK WITH LED INDICATORS

BACKGROUND OF THE INVENTION

1. Field of the Invention

The invention relates to locking devices and more particularly to an electronic lock having LED (light-emitting diode) indicators.

2. Description of Related Art

For a number of reasons, electronic locks are preferred to entirely mechanical locks in many instances. An electronic lock is a lock where electronic circuits are utilized for determining the identity of a presented key and for releasing an opening movement of essentially ordinary mechanical details, if the identity of the key is the correct one.

However, a number of drawbacks have been found in typical electronic locks. For example, electronic locks can be de-energized in the event of a power outage, disabling security. Further, additional keys are required to reset a password and this can complicates the components and circuitry.

Thus, the need for improvement still exists.

SUMMARY OF THE INVENTION

It is therefore one object of the invention to provide an electronic lock for locking or unlocking a door of a safe, comprising a housing mounted on the door; an axis-shaped coder disposed in the housing; a dial mounted on the coder; a plurality of sources of illumination disposed in the housing; an electromechanical solenoid disposed in the housing; a latch bolt operatively connected to the electromechanical solenoid; a fastening unit disposed in the housing and including a clamping element put on the latch bolt; a pin tumbler lock secured to the housing and including a keyhole and a lever; a microcontroller disposed in the housing for controlling the coder, the electromechanical solenoid, and the sources of illumination; and a battery disposed in the housing for supplying electricity to the coder, the microcontroller, the electromechanical solenoid, and the sources of illumination; wherein a pressing of the dial presses the coder to activate the microcontroller, thereby activating the sources of illumination to emit light; wherein a rotation of the dial causes the coder to generate a coded signal which is in turn decoded by the microcontroller; and wherein in response to the battery being sufficiently discharged, an insertion of a key into the keyhole to rotate the lever rotates the fastening unit, thereby causing the clamping element to activate the electromechanical solenoid which in turn retracts the latch bolt from a locked position of the door to an unlocked position of the door.

The above and other objects, features and advantages of the invention will become apparent from the following detailed description taken with the accompanying drawings.

DETAILED DESCRIPTION OF THE INVENTION

Figure 1:
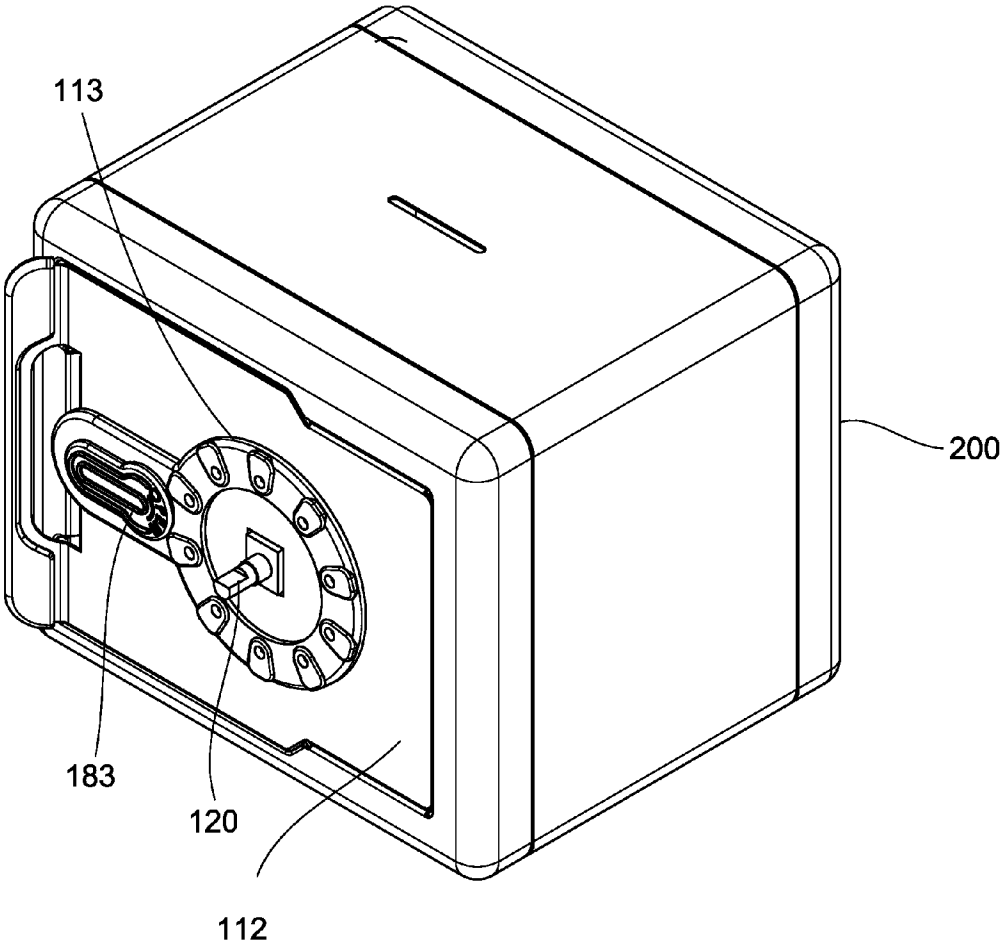
FIG. 1 is a perspective view of an electronic lock according to the invention, the electronic lock mounted on a safe and a dial removed.
Figure 2:
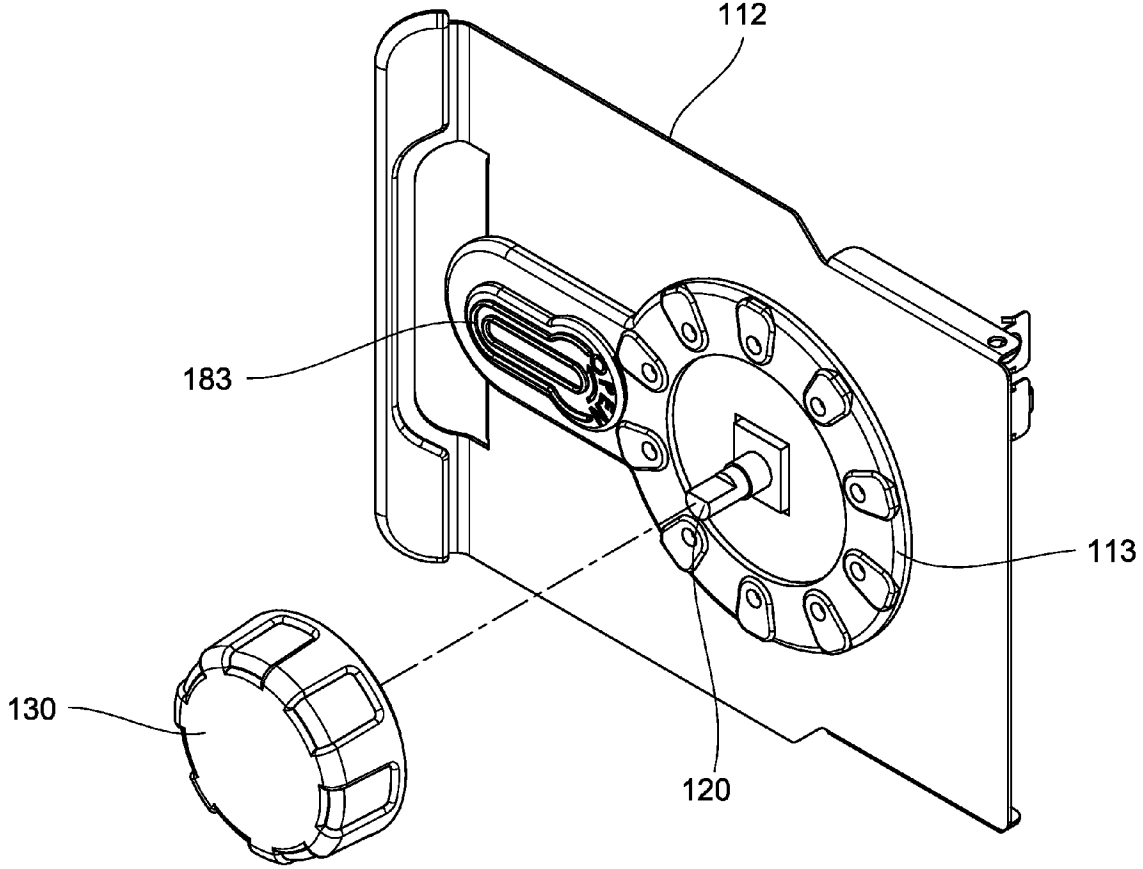
FIG. 2 is a perspective view of the electronic lock with the dial detached.
Figure 3:
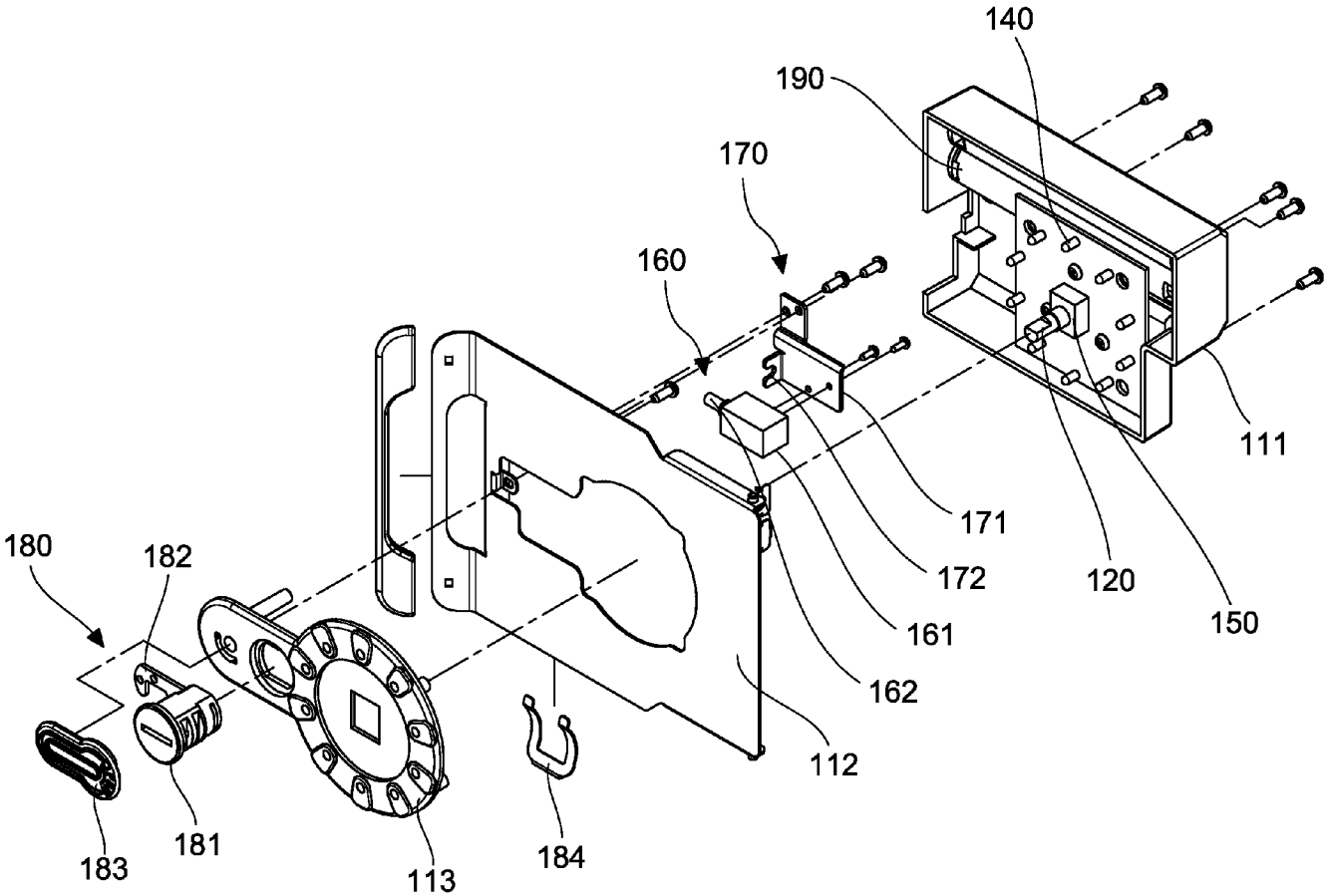
FIG. 3 is an exploded view of the electronic lock of FIG. 2 with the dial removed.
Figure 4:
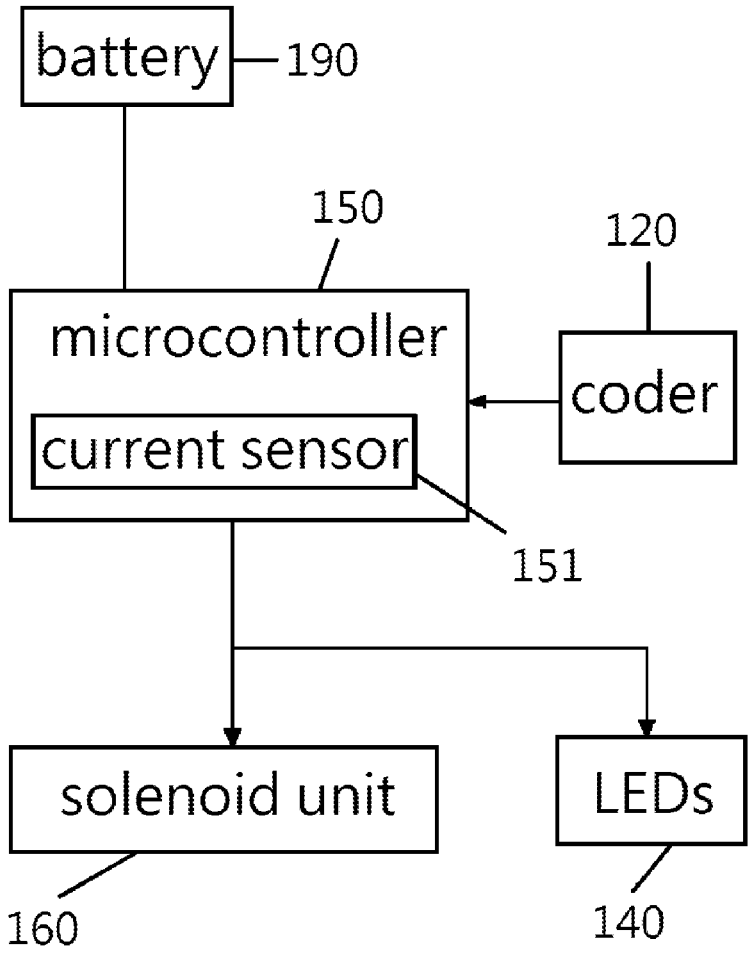
FIG. 4 is a block diagram of the electronic lock.
Figure 5:
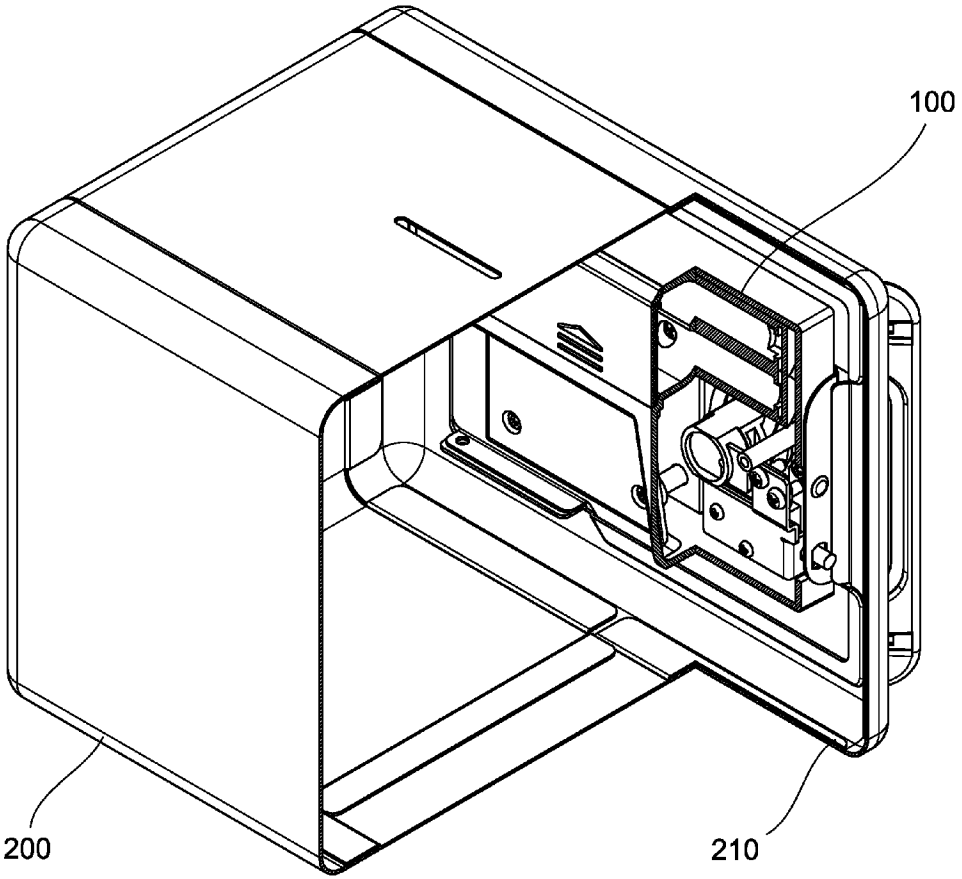
FIG. 5 is a fragmentary sectional view of the safe to show details of the electronic lock.
Figure 6:
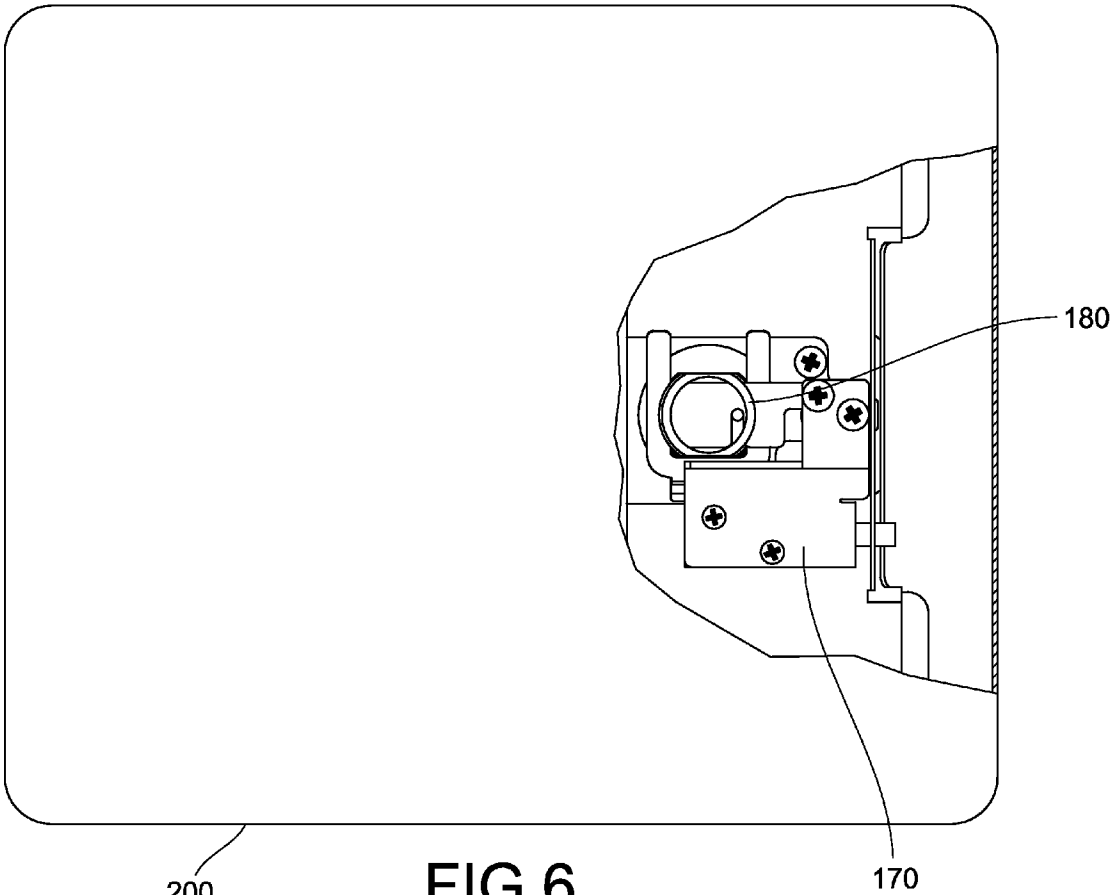
FIG. 6 is a side elevation of FIG. 5.
Figure 7:
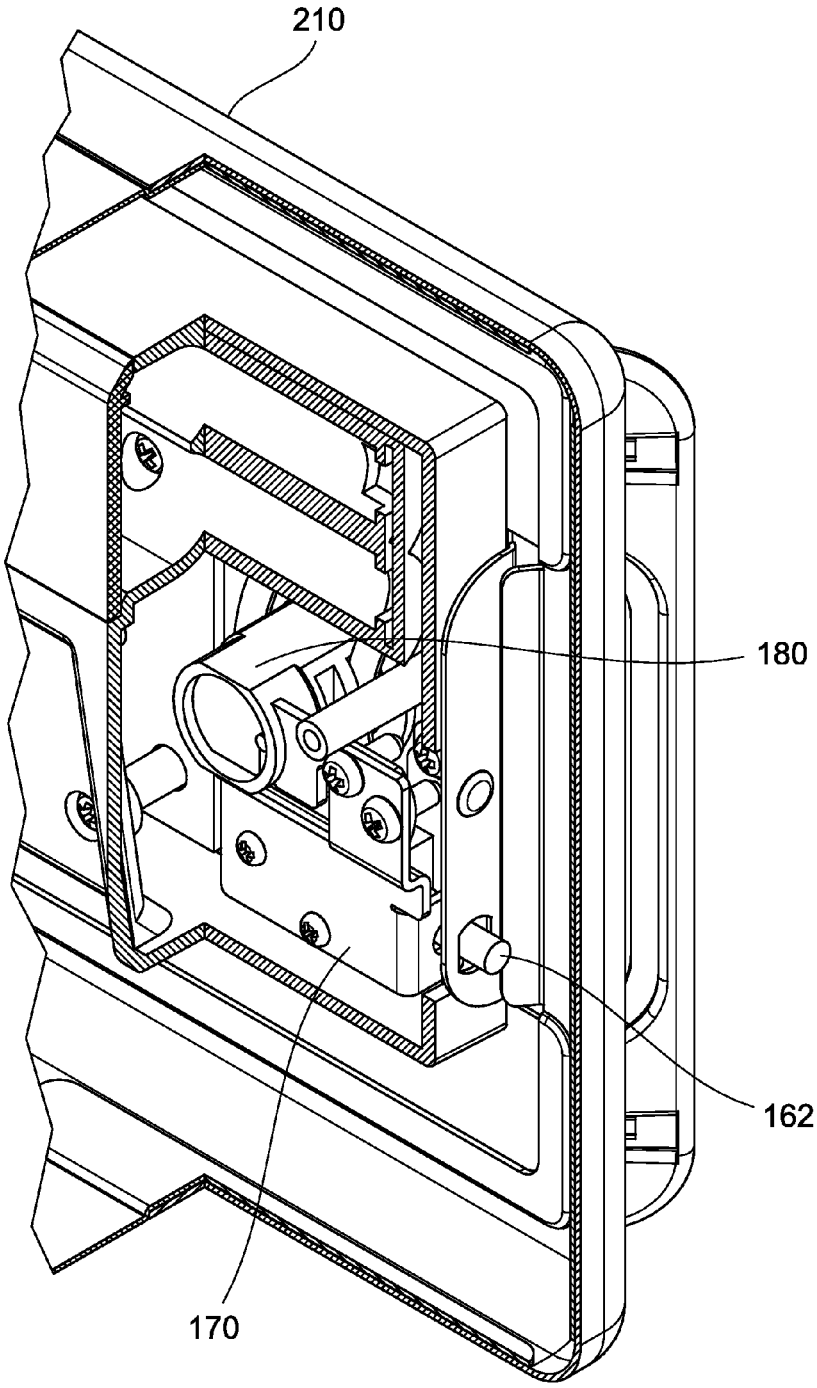
FIG. 7 is an enlarged view of the electronic lock shown in FIG. 5.
Figure 8:
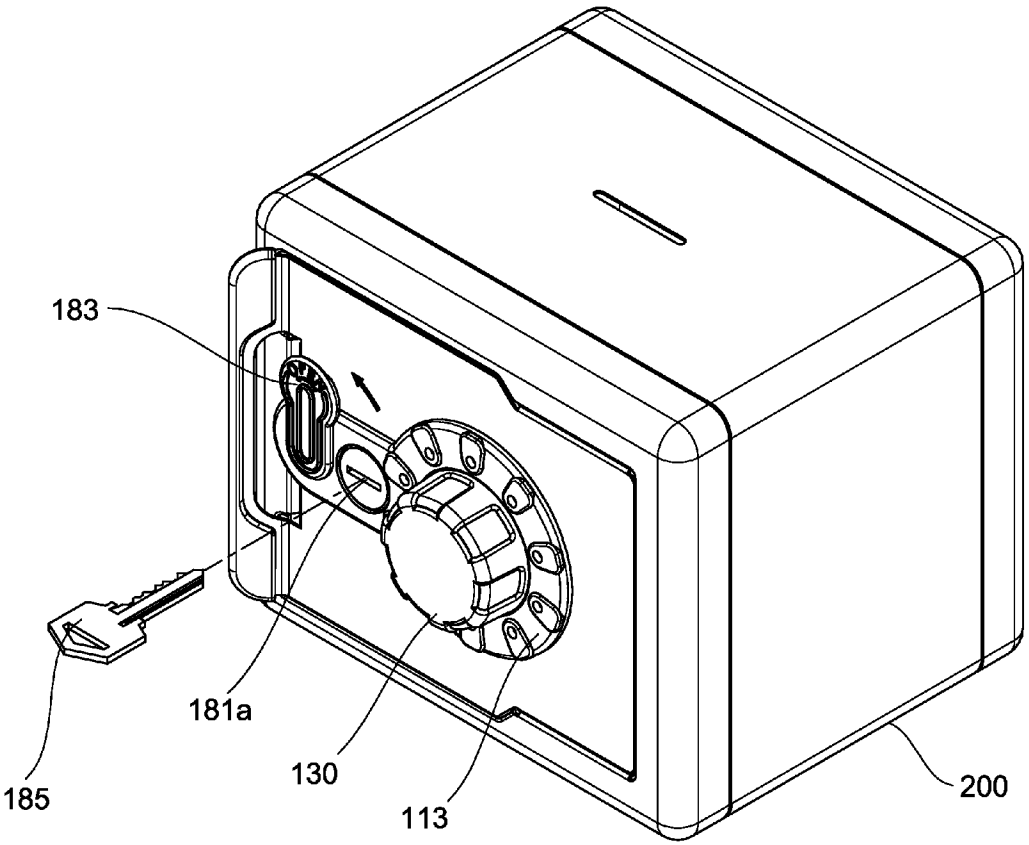
FIG. 8 is a view similar to FIG. 1 with the dial mounted and a key to be inserted into the keyhole.

Referring to FIGS. 1 to 8, an electronic lock 100 in accordance with the invention is mounted on a door 210 of a safe 200 and comprises the following components as discussed in detail below.

A housing 111 is mounted on an inner surface of the door 210. A hollow mounting plate 112 is mounted on an outer surface of the door 210 and aligns with the housing 111. A cover member 113 is mounted on the mounting plate 112. An axis-shaped coder 120 is provided in the housing 111 and extends forward out of the cover member 113 to be joined an external dial 130 which is adapted to rotate. A plurality of LEDs 140 are arranged as a circle and equally spaced in the housing 111. The LEDs 140 are further disposed in a plurality of through holes (not numbered) in the dial 130 respectively. A microcontroller 150 is adjacent to the coder 120 and electrically connected thereto. A rotation of the dial 130 causes the coder 120 to generate a coded signal which is in turn decoded by the microcontroller 150.

A solenoid unit 160 is provided in the housing 111 and electrically connected to the microcontroller 150. The solenoid unit 160 includes a casing 161 and an electromechanical solenoid activated latch bolt 162 partially disposed in the casing 161. A fastening unit 170 is disposed in the housing 111 and includes a plate element 171 threadedly secured to the casing 161, and a clamping element 172 put on the electromechanical solenoid activated latch bolt 162 and engaged with an end surface of the casing 161. A pin tumbler lock 180 is secured to the cover member 113 and disposed in the housing 111. The pin tumbler lock 180 includes a locking mechanism 181, a lever 182, and a pivotal cover element 183 for covering a keyhole 181*a* of the locking mechanism 181 in an inoperative position, and a U-shaped clamp 184 for fastening the locking mechanism 181. A key 185 can be inserted into the keyhole 181*a* to rotate the locking mechanism 181 which in turn pushes the fastening unit 170. A battery 190 is disposed in the housing 111 for supplying electricity to the coder 120, the microcontroller 150, the solenoid unit 160, and the LEDs 140.

The microcontroller 150 comprises a current sensor 151 for sensing whether the battery 190 is low or not. The LEDs 140 may flash for warning a user in response to receiving a low current signal of the battery 190 from the current sensor 151.

In use a user may push the dial 130 and thus the coder 120. And in turn, the microcontroller 15 activates the LEDs 140 to emit light. Next, the user may repeatedly rotate the dial 130 to input password.

The electronic lock 100 is disabled if the battery 190 is low. In response, a user may insert a key 185 into the keyhole 181*a* to activate (i.e., rotate) the pin tumbler lock 180. And in turn, the lever 182 rotates to rotate the plate element 171. And in turn the clamping element 172 pushes the casing 161. And in turn, the electromechanical solenoid activated latch bolt 162 retracts to clear out of the edge of the opening of the safe 200. As a result, the safe 200 is open.

While the invention has been described in terms of preferred embodiments, those skilled in the art will recognize that the invention can be practiced with modifications within the spirit and scope of the appended claims.

What is claimed is:

1. An electronic lock for locking or unlocking a door of a safe, comprising:

a housing mounted on the door;

an axis-shaped coder disposed in the housing;

a dial mounted on the coder;

a plurality of sources of illumination disposed in the housing;

an electromechanical solenoid disposed in the housing;

a latch bolt operatively connected to the electromechanical solenoid;

a fastening unit disposed in the housing and including a clamping element put on the latch bolt;

a pin tumbler lock secured to the housing and including a keyhole and a lever;

a microcontroller disposed in the housing for controlling the coder, the electromechanical solenoid, and the sources of illumination; and a battery disposed in the housing for supplying electricity to the coder, the microcontroller, the electromechanical solenoid, and the sources of illumination;

wherein a pressing of the dial presses the coder to activate the microcontroller, thereby activating the sources of illumination to emit light;

wherein a rotation of the dial causes the coder to generate a coded signal which is in turn decoded by the microcontroller; and wherein in response to the battery being sufficiently discharged, an insertion of a key into the keyhole to rotate the lever rotates the fastening unit, thereby causing the clamping element to activate the electromechanical solenoid which in turn retracts the latch bolt from a locked position of the door to an unlocked position of the door.

2. The electronic lock of claim 1, wherein the microcontroller comprises a current sensor for sensing whether the battery is low or not.

3. The electronic lock of claim 2, wherein the sources of illumination are a plurality of LEDs electrically connected to the current sensor.

4. The electronic lock of claim 3, wherein the LEDs flash in response to receiving a low current signal of the battery from the current sensor.

* * * * *